United States Patent [19]

Vincent

[11] Patent Number: 4,593,468

[45] Date of Patent: Jun. 10, 1986

[54] CONVERTIBLE NOTE PAD AND PENCIL SHARPENER

[76] Inventor: Robert R. Vincent, 2256 S. Dollsion, Springfield, Mo. 65807

[21] Appl. No.: 666,114

[22] Filed: Oct. 29, 1984

[51] Int. Cl.[4] ..... B43L 23/00

[52] U.S. Cl. ..... 30/451; 30/454; 30/459

[58] Field of Search ..... 145/3.1, 3.3, 3.31, 145/3.32, 3.5, 3.6, 3.61

[56] References Cited

U.S. PATENT DOCUMENTS

| | | | |
|---|---|---|---|
| 279,656 | 6/1883 | Maggio | 145/3.6 |
| 414,463 | 11/1889 | Walker | 145/3.61 |
| 432,831 | 7/1890 | Legge | 145/3.3 |
| 466,704 | 1/1892 | Reily . | |
| 517,784 | 4/1894 | Werner | 145/3.61 |
| 759,499 | 5/1904 | Brandes . | |
| 1,558,818 | 10/1925 | Kumagai | 145/3.6 |
| 1,893,877 | 1/1933 | Appel | 145/3.3 |
| 2,132,121 | 10/1938 | Nudelman | 145/3.31 |

FOREIGN PATENT DOCUMENTS

| | | | |
|---|---|---|---|
| 6510 | 3/1932 | Australia | 145/3.61 |
| 382304 | 10/1932 | United Kingdom | 30/454 |
| 1562851 | 3/1980 | United Kingdom | 145/3.61 |

*Primary Examiner*—Frederick R. Schmidt
*Assistant Examiner*—J. T. Zatarga
*Attorney, Agent, or Firm*—D. A. N. Chase; Michael Yakimo, Jr.

[57] ABSTRACT

Stationary apparatus presenting a combination memo pad holder and pencil sharpener assembly. The apparatus generally comprises a main housing having a compartment for insertion of a note pad therein. Flanges on the sharpener assembly releasably engage tracks on the housing so as to position the assembly in a first position if the apparatus is used on a desk top and a second position if the apparatus is attached to a wall or the like. The offset positions of the sharpener assembly enables a pencil to be inserted therein in a ready-for-use position.

8 Claims, 8 Drawing Figures

CONVERTIBLE NOTE PAD AND PENCIL SHARPENER

BACKGROUND OF THE INVENTION

This invention relates to stationery equipment and more particularly, to a combination pencil sharpener and note pad holder selectably interchangeable between two modes of operation according to the location of use.

Many types of pencil sharpeners and note pad holders are being severally used in the prior art. However, it is desirable to present a combined pencil sharpener and note pad which presents to the user a note pad, pencil and means for readily sharpening the same.

I have found it further desirable to have apparatus which combines a pencil sharpener and note pad for effective use in a vertical position, as affixed to a wall, or in a horizontal position, as resting on a horizontal surface such as a desk top or the like. In these two modes of operation, it is particularly advantageous to have the pencil sharpener positioned so that it can be easily utilized.

In response thereto, I have invented a combined note pad holder and pencil sharpener which employs a housing for retaining a note pad therein irrespective of whether the pad is positioned in vertical or horizontal positions/modes of operation. Furthermore, the pencil sharpener is releasably engageable with the note pad by means of cooperating flanges and tracks so as to be disposed in easily utilized positions. Accordingly, a combined note pad, pencil and sharpening means is presented to the user for use in either vertical or horizontal positions/modes of operation.

It is therefore a general object of this invention to provide a combined note pad holder/pencil sharpener which has two modes of operation for use in either horizontal or vertical positions.

A further object of this invention is to provide apparatus, as aforesaid, which presents the pencil sharpener in a readily utilized position irrespective of its mode of operation.

Still another object of this invention is to provide apparatus, as aforesaid, which readily presents a memo pad in a ready position irrespective of the mode of operation.

A more particular object of this invention is to provide apparatus, as aforesaid, having a pencil sharpener which is selectably positioned relative to the note pad according to the desired mode of operation.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
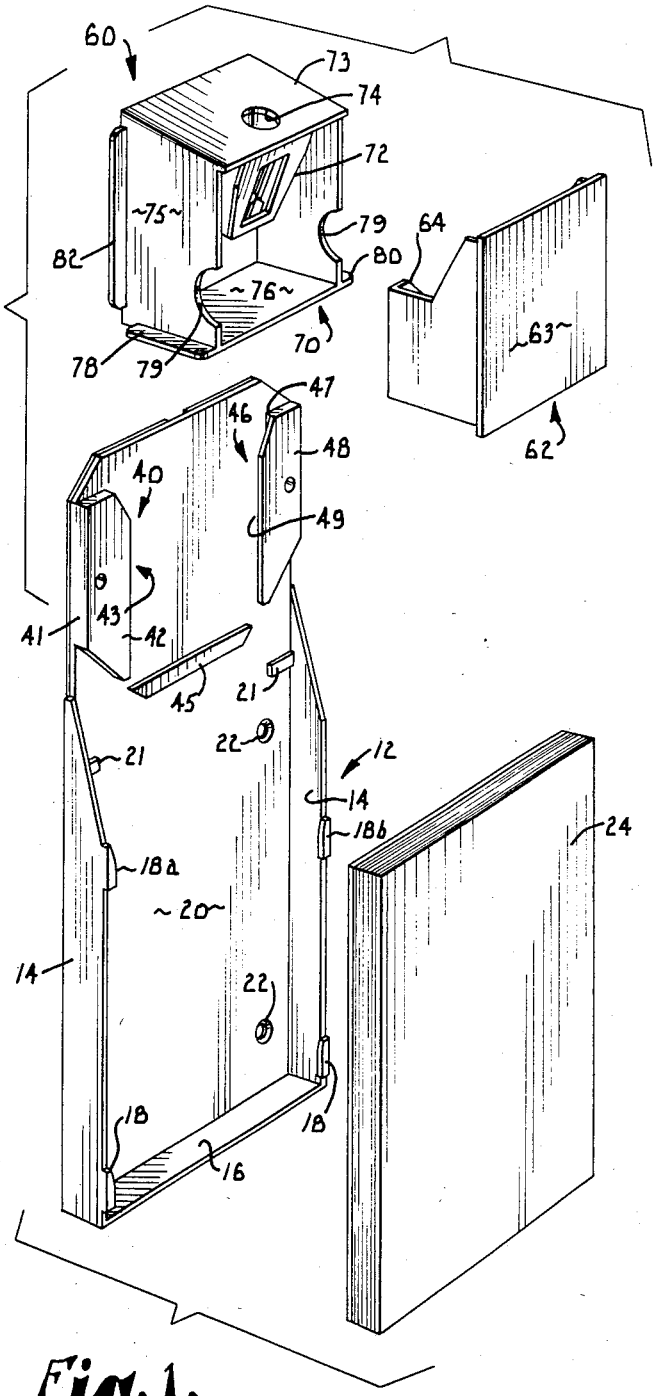
FIG. 1 is an exploded, perspective view of the combined note pad holder and pencil sharpener as shown in a vertical position/mode of operation.

Turning more particularly to the drawings, FIG. 1 illustrates the stationery apparatus 10 as comprising a generally rectangular housing 12 having laterally spaced-apart, normally-extending side walls 14 and a normally-extending end wall 16. Located at the top of the side walls 14 are interiorly extending flanges 18. A back wall 20 spans the side walls 14 and includes a plurality of apertures 22 therein for extension of wall fasteners, such as screws, nails, etc., therethrough.

Figure 2:
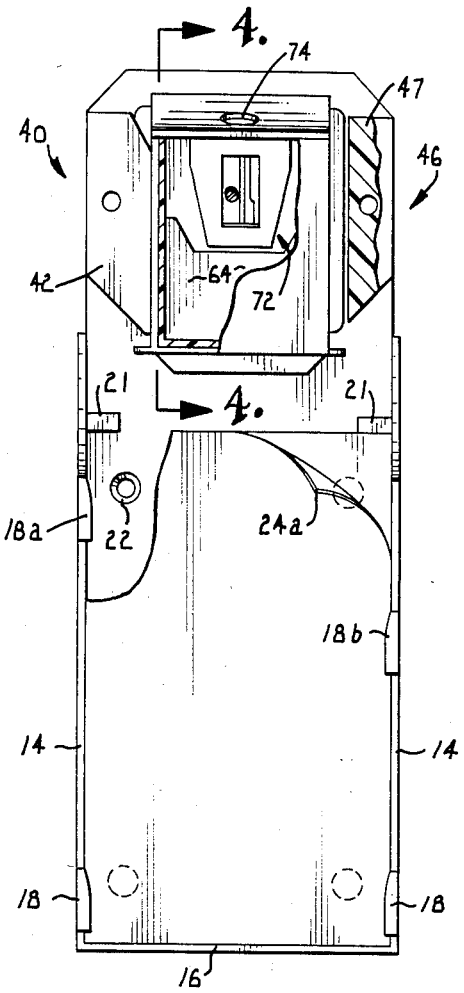
FIG. 2 is a front view of the apparatus of FIG. 1 with a portion of the note pad broken away to show the rear wall of the housing; a portion of the front wall of the removable housing of the pencil sharpener broken away to show the interior thereof and a portion of a track structure broken away to show an underlying flange.
Figure 3:
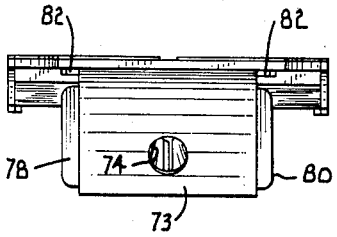
FIG. 3 is a top view of the apparatus in FIG. 2.
Figure 4:
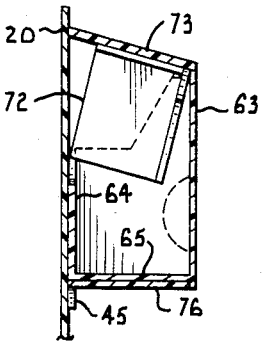
FIG. 4 is a sectional view taken along line 4—4 in FIG. 2 and illustrating the interior of the pencil sharpener assembly.

Each flange 18 normally extends from the top of the respective side walls 14 and to the interior of housing 12. A note pad 24 is insertable within the confines of the compartment presented by housing 12 and is held therein by the flanges 18. Ribs 21 bear along the top of the pad (FIG. 5) and cooperate with wall 16 to provide for a friction fit of the pad 24 therebetween. It is noted that flange **18*b* is offset from flange 18*a*. This offset allows each page 24' of the pad 24 to be easily removed from the pad 24 and housing 12 upon grasping the corner 24*a* of each page 24' adjacent flange 18*b* and moving corner 24*a* towards the rear wall 16 as shown in FIG. 2**

Located at the top of the back wall 20 of the housing 12 are first 40 and second 46 track structures. Each structure 40, 46 comprises a support flange 41, 47 and an overlying track flange 42, 48 extending toward the center of the housing 12. Flanges 42, 48 cooperate with support flanges 41, 47 and with the parallel rear wall 20 to present slots 43, 49 therebetween. Flange 45 traverses the first 40 and second 46 track structures at the interiorly disposed ends thereof for a purpose to be subsequently described.

Figure 7:
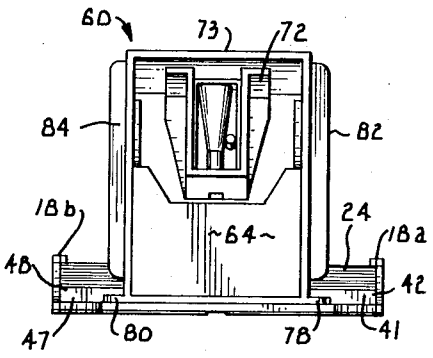
FIG. 7 is a rear view of the apparatus shown in FIG. 6.

A pencil sharpener assembly 60 includes a removable housing 62 nested within a main housing 70. Notches 79 in the respective side walls 75, 77 of housing allow the housing 62 to be grasped for removal from its nested position. The sharpener 72 member extends from the top wall 73 of the main housing 70 and towards the base 76 thereof. Aperture 74 in top wall 73 allows access to the sharpener 72 therein. As shown in FIGS. 2 and 7, the height of the the rear wall 64 of the removable housing 62 is less than front wall 63. This differential allows the rear wall 64 to slide under the sharpener member 72 which allows for the nesting of housing 62.

Extending from opposed sides of the base 76 of housing 70 and generally coplanar with base 76 are flanges 78 and 80. A second pair of coplanar flanges 82 and 84, generally normal to flanges 78, 80, extend from the opposed sides 75, 77 of the housing 70. The flanges 78, 80 or 82, 84 are selectably slidable along the slots 43, 49 presented by the first and second track structures 40, 46.

Figure 6:
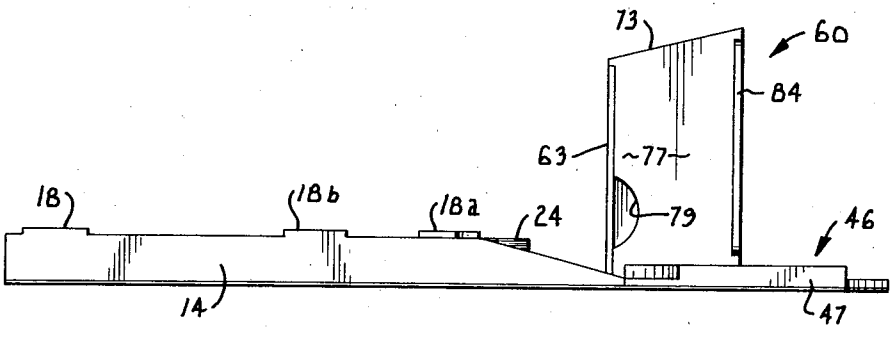
FIG. 6 is a side elevation view of the apparatus in a horizontal position/mode of operation.
Figure 8:
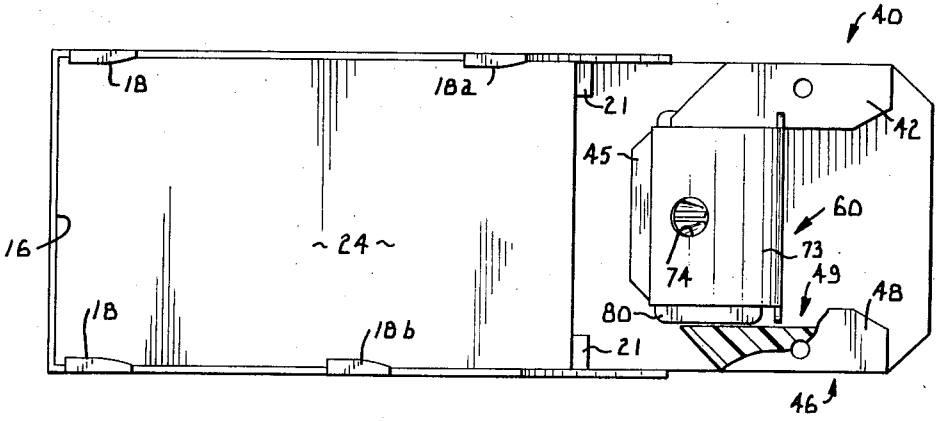
FIG. 8 is a top view of the apparatus shown in FIG. 6 with a portion of one track structure broken away to illustrate one track-engaging flange.
Figure 5:
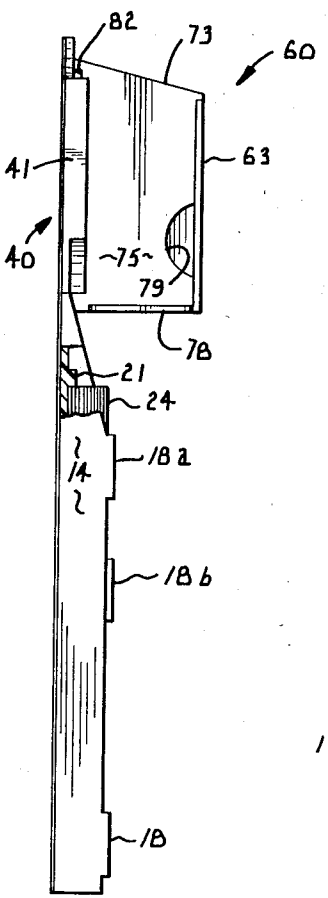
FIG. 5 is a side elevation view of the apparatus in a vertical position/mode of operation with a portion of a side wall broken away to show the fit of the note pad therein.

In use, the housing 12 may be either fastened vertically (FIG. 5) to a wall by fastener members protruding through apertures 22 and into the wall or placed in a horizontal position atop a surface such as a desk top, bookcase, etc. as shown in FIG. 6. In the vertical position/mode of operation the sharpener assembly 60 is positioned relative to the housing 12 as shown in FIG. 5. This position allows a pencil (not shown) to be inserted into aperture 74 and maintained in a ready-for-use position as can be appreciated from an inspection of FIG. 5.

To achieve this vertical mode of operation, flanges 82 and 84 engage the slots/tracks 43, 49 on the housing 12. The coplanar flanges 82, 84 are slidable along the tracks 43, 49 until the base 76 of the housing 70 contacts the traverse stop member 45. This stop member 45 precludes the housing 70 from sliding through the tracks 43, 49. Accordingly, once flanges 82, 84 engage their respective tracks, the sharpener assembly 60 is positioned so that the imaginary axis passing through aperture 74 is generally parallel to the back wall 20.

In the horizontal mode of operation, i.e. the housing 12 is placed atop a desk top or the like as in FIG. 6, the sharpener assembly 60 is positioned relative to the housing 12 as shown in FIG. 6. This position is 90° offset from that in FIG. 5 due to the normal relationship between flanges 78, 80 and 82, 84. To achieve this position the coplanar base flanges 78, 80 engage the slots/tracks 43, 49 and are slidable therealong until the stop member 45 abuts the front wall 63 of the housing 62. Accordingly, the imaginary, normal axis passing through aperture 74 is normal to the back wall 20 of housing 12. Thus, it is seen that the first and second positions of assembly 60 are offset approximately 90° due to the normal relationship between flanges 78, 80 and 82, 84.

It is noted that in either mode of operation that housing 62 is removable from its nested position, with housing 70 remaining in place. This removal enables the user to dispose of the pencil shavings accumulating in housing 62 without the need to remove the entire assembly 60. Accordingly, the sharpener assembly 60 is available for effective use and maintenance irrespective of the vertical or horizontal position of the associated housing 12.

It is to be understood that while certain forms of this invention have been illustrated and described, it is not limited thereto, except in so far as such limitations are included in the following claims.

Having thus described the invention, what is claimed as new and desired to be secured by Letters Patent is:

1. Apparatus presenting a combined pencil sharpener and note pad comprising:

a housing presenting a compartment for said note pad;

means on said first housing for maintaining said note pad within said compartment;

a sharpener assembly;

first and second fastener means on said pencil sharpener; and third fastener means on said housing presenting structure for a releasable, complementary engagement with either said first or second fastener means on said sharpener assembly, said respective engagements positioning said sharpener assembly in either first and second positions relative to said housing and said note pad maintained therein.

2. The apparatus as claimed in claim 1 wherein said housing compartment comprises a back wall, an end wall normal to said back wall and at least one side wall normal to said back wall with said maintaining means comprising a flange member extending from the top of said at least one side wall and above said note pad, whereby said flange bears against said note pad positioned within said compartment.

3. The apparatus as claimed in claim 2 further comprising at least one rib member protruding from said back wall, said rib being longitudinally spaced from said end wall to provide for a friction fit of said note pad therebetween.

4. The apparatus as claimed in claim 2 wherein said third fastener means comprises:

at least one flange member;

means for disposing said flange member above said back wall to present a slot therebetween, said first and second fastener means having complementary male members therein for releasable engagement with said slot.

5. The apparatus as claimed in claim 4 wherein said complementary male members of said first and second fastener means comprise at least one flange member selectably slidable along said at least one slot.

6. The apparatus as claimed in claim 5 wherein said flanges of said first fastener means are generally normal to said flanges of said second fastener means whereby said engagement of said respective flanges with said slot results in said first and second positions of said associated sharpener assembly being relatively offset 90° corresponding to said normal relationship of said flanges.

7. The apparatus as claimed in claim 5 wherein said housing is positioned on a horizontal surface and said first position of said pencil sharpener assembly positions a pencil inserted therein in a position normal to said underlying, horizontal surface.

8. The apparatus as claimed in claim 5 wherein said housing is attached to a generally vertical surface and said second position of said pencil sharpener assembly positions a pencil engaged therein in a position generally parallel to said vertical surface.

* * * * *